US010101091B2

(12) United States Patent
Higashiiue et al.

(10) Patent No.: US 10,101,091 B2
(45) Date of Patent: Oct. 16, 2018

(54) HEAT EXCHANGER AND REFRIGERATION CYCLE APPARATUS USING THE SAME HEAT EXCHANGER

(71) Applicant: Mitsubishi Electric Corporation, Tokyo (JP)

(72) Inventors: Shinya Higashiiue, Tokyo (JP); Akira Ishibashi, Tokyo (JP); Takashi Okazaki, Tokyo (JP); Daisuke Ito, Tokyo (JP); Shigeyoshi Matsui, Tokyo (JP); Yuki Ugajin, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 248 days.

(21) Appl. No.: 15/026,624

(22) PCT Filed: Oct. 25, 2013

(86) PCT No.: PCT/JP2013/079028
§ 371 (c)(1),
(2) Date: Apr. 1, 2016

(87) PCT Pub. No.: WO2015/059832
PCT Pub. Date: Apr. 30, 2015

(65) Prior Publication Data

US 2016/0245589 A1 Aug. 25, 2016

(51) Int. Cl.
*F28F 1/10* (2006.01)
*F28D 7/00* (2006.01)
(Continued)

(52) U.S. Cl.
CPC ..... *F28D 7/0066* (2013.01); *F25B 39/00* (2013.01); *F28D 1/0435* (2013.01);
(Continued)

(58) Field of Classification Search
CPC .. F28D 7/0066; F28D 1/0435; F28D 1/05366; F28D 1/05316; F28F 21/084; F28F 2210/08; F25B 39/00
(Continued)

(56) References Cited

U.S. PATENT DOCUMENTS 5,181,392 A * 1/1993 Itoh ..... F24F 3/153 165/240
5,205,347 A * 4/1993 Hughes ..... F25B 39/02 165/144
(Continued)

FOREIGN PATENT DOCUMENTS

EP 2031335 A2 3/2009
GB 2299656 A 10/1996
(Continued)

OTHER PUBLICATIONS

Japanese Office Action dated Apr. 25, 2017 in the corresponding JP application No. 2015-543679. (English translation attached).
(Continued)

*Primary Examiner* — Claire Rojohn, III
(74) *Attorney, Agent, or Firm* — Posz Law Group, PLC

(57) ABSTRACT

A heat exchanger including a first heat exchanger disposed on upstream side of a heat exchange fluid and a second heat exchanger disposed on downstream side of the heat exchange fluid, which are connected in series in a flow path of a heat medium, wherein the heat medium flows from the first heat exchanger to the second heat exchanger so as to be parallel to the flow of the heat exchange fluid when the heat exchanger serves as an evaporator, the heat medium flows from the second heat exchanger to the first heat exchanger so as to be opposed to the flow of the heat exchange fluid when the heat exchanger serves as a condenser, and a sum of flow path volume of first heat-transfer tubes of the first
(Continued)

heat exchanger is smaller than a sum of flow path volume of second heat-transfer tubes of the second heat exchanger.

10 Claims, 6 Drawing Sheets

(51) Int. Cl.

| | |
|---|---|
| ***F25B 39/00*** | (2006.01) |
| ***F28D 1/04*** | (2006.01) |
| ***F28F 21/08*** | (2006.01) |
| *F25B 13/00* | (2006.01) |
| *F28D 1/053* | (2006.01) |

(52) U.S. Cl.
CPC ..... *F28F 21/084* (2013.01); *F25B 13/00* (2013.01); *F25B 2313/0254* (2013.01); *F28D 1/05316* (2013.01); *F28D 1/05366* (2013.01); *F28F 2210/08* (2013.01)

(58) Field of Classification Search
USPC ..... 165/172
See application file for complete search history.

(56) References Cited

U.S. PATENT DOCUMENTS

| | | | | |
|---|---|---|---|---|
| 5,318,109 | A * | 6/1994 | Yamada | F22B 37/40 122/4 R |
| 6,116,048 | A * | 9/2000 | Hebert | F25B 39/02 62/524 |
| 6,230,506 | B1 * | 5/2001 | Nishida | B60H 1/00907 62/160 |
| 6,786,056 | B2 * | 9/2004 | Bash | F25B 5/02 62/199 |
| 6,907,922 | B2 * | 6/2005 | Katoh | F28D 1/05366 138/38 |
| 6,938,433 | B2 * | 9/2005 | Bash | F25B 5/02 62/198 |
| 7,654,108 | B2 * | 2/2010 | Ishizaka | F25B 39/02 165/153 |
| 8,037,929 | B2 * | 10/2011 | Higashiyama | F25B 39/02 165/152 |
| 8,171,747 | B2 * | 5/2012 | Kurihara | F25B 9/008 62/160 |
| 8,804,334 | B2 * | 8/2014 | Eckberg | H05K 7/2079 165/104.33 |
| 9,513,041 | B2 * | 12/2016 | Haikawa | F25B 40/02 |
| 9,625,217 | B2 * | 4/2017 | Kim | F25B 39/00 |
| 9,822,995 | B2 * | 11/2017 | Wakamoto | F25B 13/00 |
| 2012/0222848 | A1 * | 9/2012 | Sicks | F28F 9/0204 165/173 |
| 2015/0040601 | A1 * | 2/2015 | Ley | F28F 17/005 62/290 |
| 2015/0198372 | A1 * | 7/2015 | Desikan | F28D 1/0366 165/151 |
| 2016/0033182 | A1 * | 2/2016 | Joardar | F25B 39/04 62/507 |
| 2016/0054038 | A1 * | 2/2016 | Matsui | F25B 13/00 62/498 |
| 2016/0238325 | A1 * | 8/2016 | Johnson | F25B 39/00 |
| 2016/0290730 | A1 * | 10/2016 | Taras | F28D 1/0435 |
| 2017/0241684 | A1 * | 8/2017 | Ito | F25B 39/00 |
| 2017/0276414 | A1 * | 9/2017 | Higashiiue | F25B 39/028 |
| 2017/0328614 | A1 * | 11/2017 | Yokozeki | F25B 39/00 |
| 2017/0328652 | A1 * | 11/2017 | Matsui | F28F 9/0268 |
| 2017/0336145 | A1 * | 11/2017 | Nakamura | F28D 1/047 |

FOREIGN PATENT DOCUMENTS

| | | | | |
|---|---|---|---|---|
| JP | H03-255857 | A | 11/1991 | |
| JP | H06-174320 | A | 6/1994 | |
| JP | H08-210985 | A | 10/1996 | |
| JP | 09-145076 | A | 6/1997 | |
| JP | 2000-205601 | A | 7/2000 | |
| JP | 2000-329486 | A | 11/2000 | |
| JP | 2000329486 | A * | 11/2000 | F28D 1/0477 |
| JP | 2008-261517 | A | 10/2008 | |
| JP | 2009-030852 | A | 2/2009 | |
| JP | 2010-054060 | A | 3/2010 | |
| WO | 2011/055656 | A1 | 5/2011 | |

OTHER PUBLICATIONS

Extended European Search Report dated Jun. 21, 2017 issued in corresponding EP application No. 13895851.7.
Office Action dated Oct. 4, 2016 issued in corresponding JP patent application No. 2015-543679 (and English translation).
International Search Report of the International Searching Authority dated Jan. 21, 2014 for the corresponding International application No. PCT/JP2013/079028 (and English translation).
Office Action dated Feb. 24, 2017 issued in corresponding CN patent application No. 201380080466.0 (and English translation).

* cited by examiner

FIG. 3

THE SUM OF FLOW PATH VOLUME OR HYDRAULIC EQUIVALENT DIAMETERS (EQUIVALENT DIAMETERS) OF HEAT-TRANSFER TUBES

| | FIRST HEAT SOURCE SIDE HEAT EXCHANGER | SECOND HEAT SOURCE SIDE HEAT EXCHANGER |
|---|---|---|
| [1] | LARGE (FOR EXAMPLE, CIRCULAR TUBE) | LARGE (FOR EXAMPLE, CIRCULAR TUBE) |
| [2] | LARGE (FOR EXAMPLE, CIRCULAR TUBE) | SMALL (FOR EXAMPLE, FLAT TUBE) |
| [3] | SMALL (FOR EXAMPLE, FLAT TUBE) | LARGE (FOR EXAMPLE, CIRCULAR TUBE) |
| [4] | SMALL (FOR EXAMPLE, FLAT TUBE) | SMALL (FOR EXAMPLE, FLAT TUBE) |

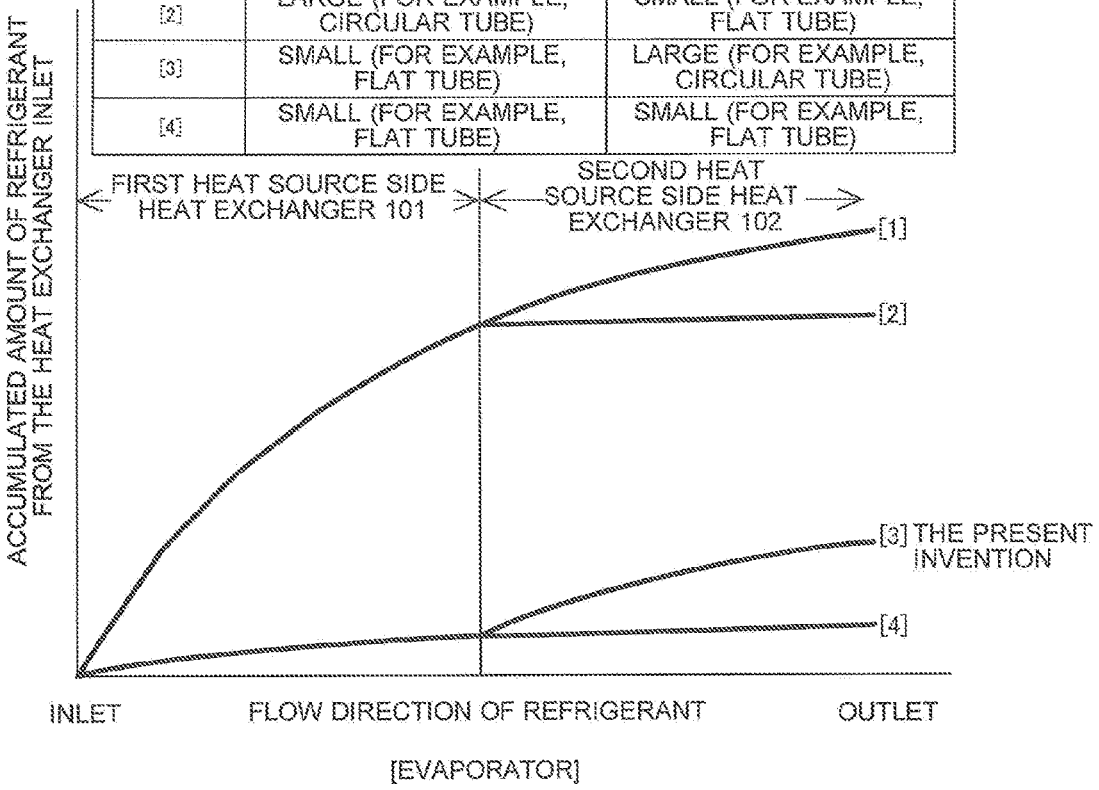

[EVAPORATOR]

FIG. 4

THE SUM OF FLOW PATH VOLUME OR HYDRAULIC EQUIVALENT DIAMETERS (EQUIVALENT DIAMETERS) OF HEAT-TRANSFER TUBES

| | FIRST HEAT SOURCE SIDE HEAT EXCHANGER | SECOND HEAT SOURCE SIDE HEAT EXCHANGER |
|---|---|---|
| [1] | LARGE (FOR EXAMPLE, CIRCULAR TUBE) | LARGE (FOR EXAMPLE, CIRCULAR TUBE) |
| [2] | LARGE (FOR EXAMPLE, CIRCULAR TUBE) | SMALL (FOR EXAMPLE, FLAT TUBE) |
| [3] | SMALL (FOR EXAMPLE, FLAT TUBE) | LARGE (FOR EXAMPLE, CIRCULAR TUBE) |
| [4] | SMALL (FOR EXAMPLE, FLAT TUBE) | SMALL (FOR EXAMPLE, FLAT TUBE) |

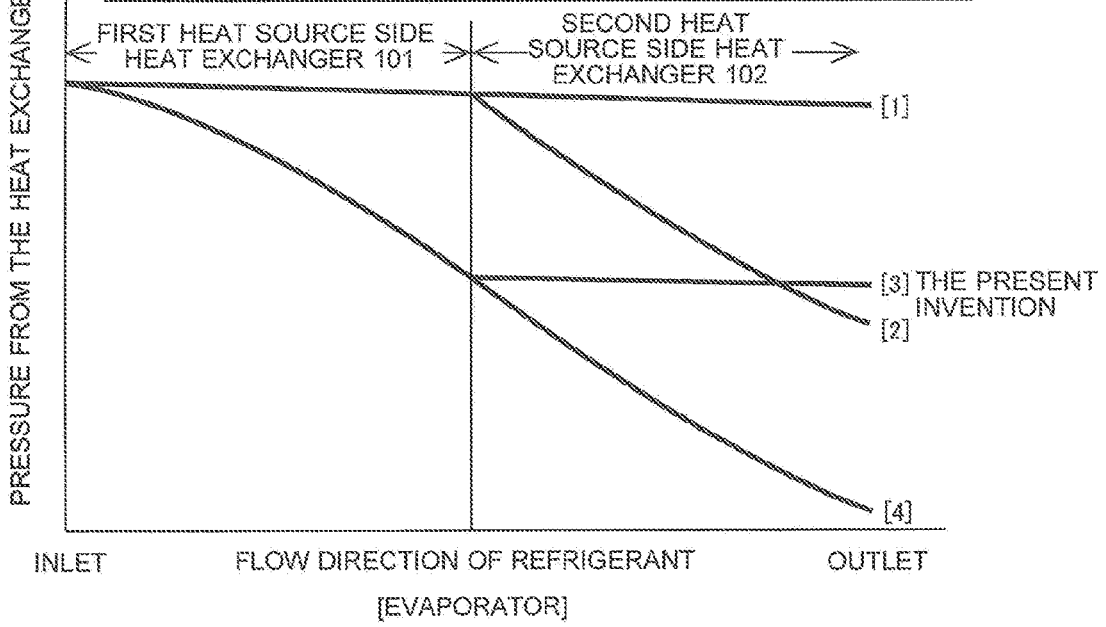

FIG. 5

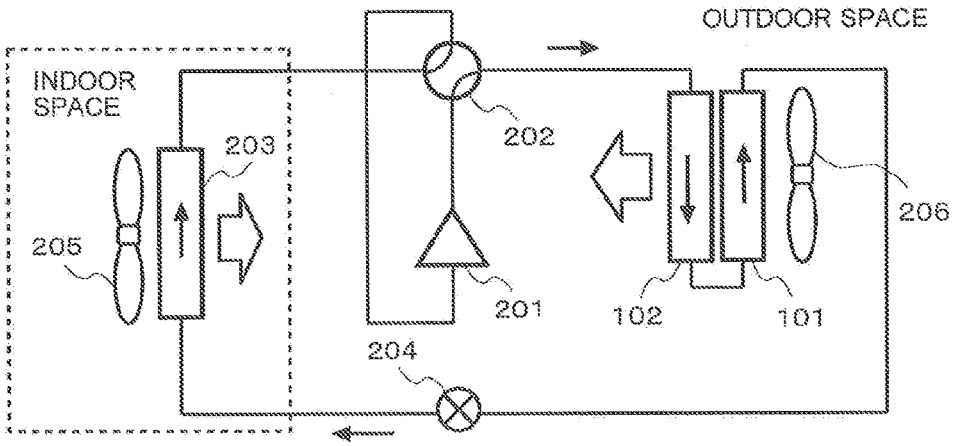

FIG. 6

THE SUM OF FLOW PATH VOLUME OR HYDRAULIC EQUIVALENT DIAMETERS (EQUIVALENT DIAMETERS) OF HEAT-TRANSFER TUBES

| | FIRST HEAT SOURCE SIDE HEAT EXCHANGER | SECOND HEAT SOURCE SIDE HEAT EXCHANGER |
|---|---|---|
| [1] | LARGE (FOR EXAMPLE, CIRCULAR TUBE) | LARGE (FOR EXAMPLE, CIRCULAR TUBE) |
| [2] | LARGE (FOR EXAMPLE, CIRCULAR TUBE) | SMALL (FOR EXAMPLE, FLAT TUBE) |
| [3] | SMALL (FOR EXAMPLE, FLAT TUBE) | LARGE (FOR EXAMPLE, CIRCULAR TUBE) |
| [4] | SMALL (FOR EXAMPLE, FLAT TUBE) | SMALL (FOR EXAMPLE, FLAT TUBE) |

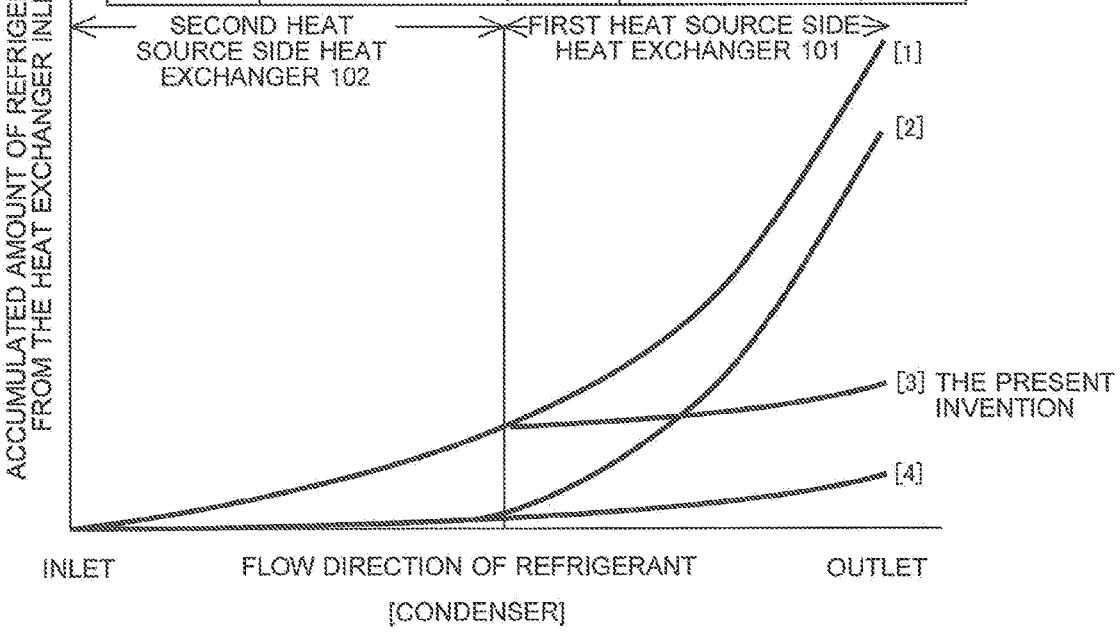

FIG. 7

THE SUM OF FLOW PATH VOLUME OR HYDRAULIC EQUIVALENT DIAMETERS (EQUIVALENT DIAMETERS) OF HEAT-TRANSFER TUBES

| | FIRST HEAT SOURCE SIDE HEAT EXCHANGER | SECOND HEAT SOURCE SIDE HEAT EXCHANGER |
|---|---|---|
| [1] | LARGE (FOR EXAMPLE, CIRCULAR TUBE) | LARGE (FOR EXAMPLE, CIRCULAR TUBE) |
| [2] | LARGE (FOR EXAMPLE, CIRCULAR TUBE) | SMALL (FOR EXAMPLE, FLAT TUBE) |
| [3] | SMALL (FOR EXAMPLE, FLAT TUBE) | LARGE (FOR EXAMPLE, CIRCULAR TUBE) |
| [4] | SMALL (FOR EXAMPLE, FLAT TUBE) | SMALL (FOR EXAMPLE, FLAT TUBE) |

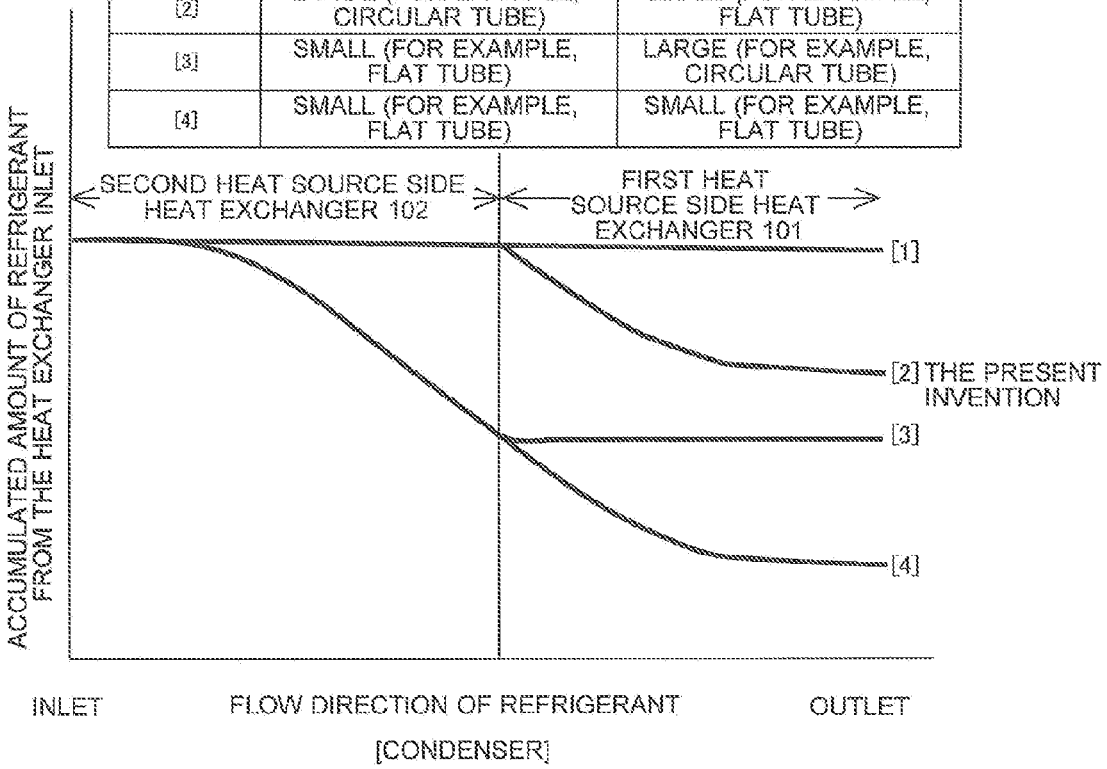

FIG. 8

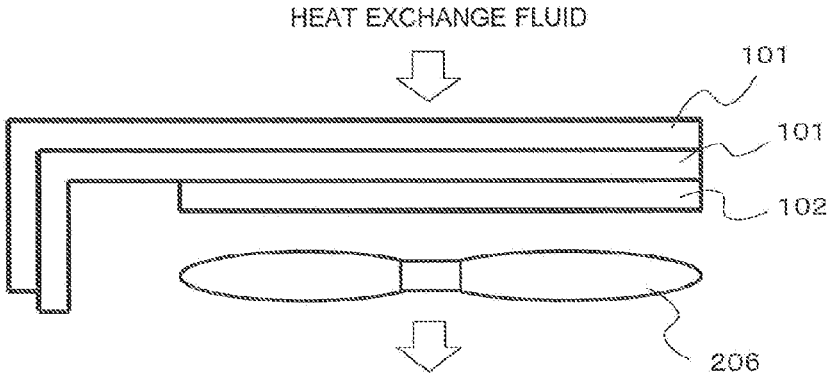

Fig. 9

COMPARISONS BETWEEN THE FIRST HEAT EXCHANGER AND THE SECOND HEAT EXCHANGER

| | |
|---|---|
| [1] | A PITCH BETWEEN THE FIRST HEAT-TRANSFER TUBES IS SMALLER THAN A PITCH BETWEEN THE SECOND HEAT-TRANSFER TUBES |
| [2] | A CROSS SECTIONAL AREA OF FINS OF THE FIRST HEAT EXCHANGER IS LARGER THAN A CROSS SECTIONAL AREA OF FINS OF THE SECOND HEAT EXCHANGER |
| [3] | A SUM OF IN-TUBE HEAT TRANSFER AREAS OF THE FIRST HEAT-TRANSFER TUBES IS LARGER THAN A SUM OF IN-TUBE HEAT TRANSFER AREAS OF THE SECOND HEAT-TRANSFER TUBES |

HEAT EXCHANGER AND REFRIGERATION CYCLE APPARATUS USING THE SAME HEAT EXCHANGER

CROSS REFERENCE TO RELATED APPLICATION

This application is a U.S. national stage application of International Application No. PCT/JP2013/079028 filed on Oct. 25, 2013, the disclosure of which is incorporated herein by reference.

TECHNICAL FIELD

The present invention relates to a heat exchanger having a plurality of rows of heat-transfer tubes through which refrigerant flows with respect to a flowing direction of heat exchange fluid (for example, air).

BACKGROUND ART

While an HFC-based refrigerant is used for refrigeration cycle apparatuses, there is a problem that a HFC-based refrigerant has high global warming potential. As a result, leakage of refrigerant from a refrigeration cycle apparatus has a significant effect on global warming. Accordingly, a technique of reducing the amount of refrigerant to be sealed in the refrigeration cycle apparatus is required.

During operation of the refrigeration cycle apparatus, since a major part of refrigerant sealed in the refrigeration cycle apparatus is stagnated in the heat exchanger, it is important to reduce the amount of stagnating refrigerant by reducing the volume of the heat-transfer tubes of the heat exchanger.

In some conventional heat exchangers, a plurality of rows of heat-transfer tubes are formed of a combination of flat tubes and circular tubes so as to improve heat exchange efficiency (see Patent Literature 1).

CITATION LIST

Patent Literature

Patent Literature 1: Japanese Unexamined Patent Application Publication No. 2010-54060 (e.g., see FIGS. 1, 9)

SUMMARY OF INVENTION

Technical Problem

In the conventional heat exchangers, a circular tube having a large volume is used for a heat-transfer tube on upstream side and a flat tube having a small volume is used on downstream side. As a consequence, air and refrigerant flow as an opposed flow when the heat exchanger is used as a condenser, and air and refrigerant flow as a parallel flow when the heat exchanger is used as an evaporator. This causes a problem that refrigerant having a large density is stagnated in the circular tube having a large volume and the stagnating amount of refrigerant increases.

Further, when a flat multi-hole tube or a circular tube of a small diameter is used as a heat-transfer tube for the purpose of reducing the amount of refrigerant and increasing performance, there is a problem that a pressure loss in the heat-transfer tube increases and an operation efficiency of the refrigeration cycle decreases.

The present invention has been made to overcome the above problems, and an object of the invention is to provide a heat exchanger capable of reducing the amount of refrigerant stagnated in the heat-transfer tubes and decreasing the pressure loss of the heat-transfer tube as a whole by adjusting flow path volume or a hydraulic equivalent diameter of each of the heat-transfer tubes which are arranged in row direction and are used as a condenser and an evaporator, and to provide a refrigeration cycle apparatus having the same heat exchanger.

Solution to Problem

According to an aspect of the present invention, a heat exchanger includes a first heat exchanger disposed on upstream side of a heat exchange fluid and a second heat exchanger disposed on downstream side of the heat exchange fluid, the first heat exchanger and the second heat exchanger being connected in series in a flow path of a heat medium, wherein the heat exchanger is configured to allow the heat medium to flow from the first heat exchanger to the second heat exchanger so as to be parallel to the flow of the heat exchange fluid when the heat exchanger serves as an evaporator, and allow the heat medium to flow from the second heat exchanger to the first heat exchanger so as to be opposed to the flow of the heat exchange fluid when the heat exchanger serves as a condenser, and a sum of flow path volume of first heat-transfer tubes of the first heat exchanger is smaller than a sum of flow path volume of second heat-transfer tubes of the second heat exchanger.

Advantageous Effects of Invention

According to a heat exchanger of the present invention, the amount of refrigerant stagnated in the heat-transfer tubes can be reduced and the pressure loss in the heat-transfer tubes of the heat exchanger as a whole can be reduced.

BRIEF DESCRIPTION OF DRAWINGS

FIG. 3 is a diagram which shows an accumulated amount of refrigerant stagnated in the heat-transfer tube when the heat source side heat exchanger according to Embodiment 1 is used as an evaporator.

FIG. 4 is a diagram which shows pressure loss generated in the heat-transfer tube when the heat source side heat exchanger according to Embodiment 1 is used as an evaporator.

FIG. 5 is a diagram of a refrigerant circuit that performs a cooling operation while the heat exchanger according to Embodiment 1 is mounted on the heat source unit.

FIG. 6 is a diagram which shows an accumulated amount of refrigerant stagnated in the heat-transfer tube when the heat source side heat exchanger according to Embodiment 1 is used as a condenser.

FIG. 7 is a diagram which shows pressure loss generated in the heat-transfer tube when the heat source side heat exchanger according to Embodiment 1 is used as a condenser.

FIG. 8 is a schematic view which shows the heat exchanger according to Embodiment 2 is applied to an outdoor unit.

FIG. 9 identifies relationships between the first heat-transfer tubes and the second heat-transfer tubes as well as the first heat exchanger and the second heat exchanger.

DESCRIPTION OF EMBODIMENTS

Figure 1:
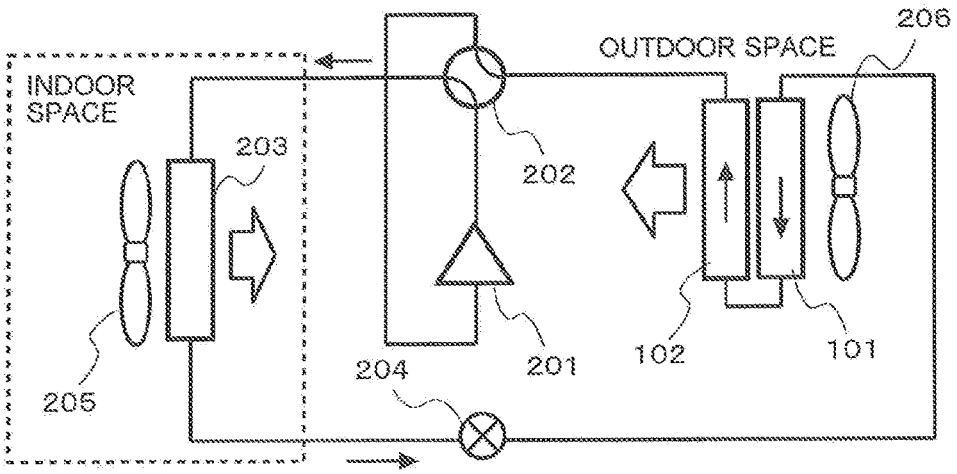
FIG. 1 is a diagram of a refrigerant circuit that performs a heating operation while a heat exchanger according to Embodiment 1 is mounted on a heat source unit.

With reference to the drawings, embodiments of the present invention will be described.

A configuration described below is merely an example, and a heat exchanger according to the present invention is not limited to the configuration described herein.

Details of the configuration are simplified or omitted in the drawings as appropriate.

Further, duplicated or similar description is simplified or omitted as appropriate.

Embodiment 1

FIG. 1 is a diagram of a refrigerant circuit that performs a heating operation while a heat exchanger according to Embodiment 1 is mounted on a heat source unit.

Figure 2:
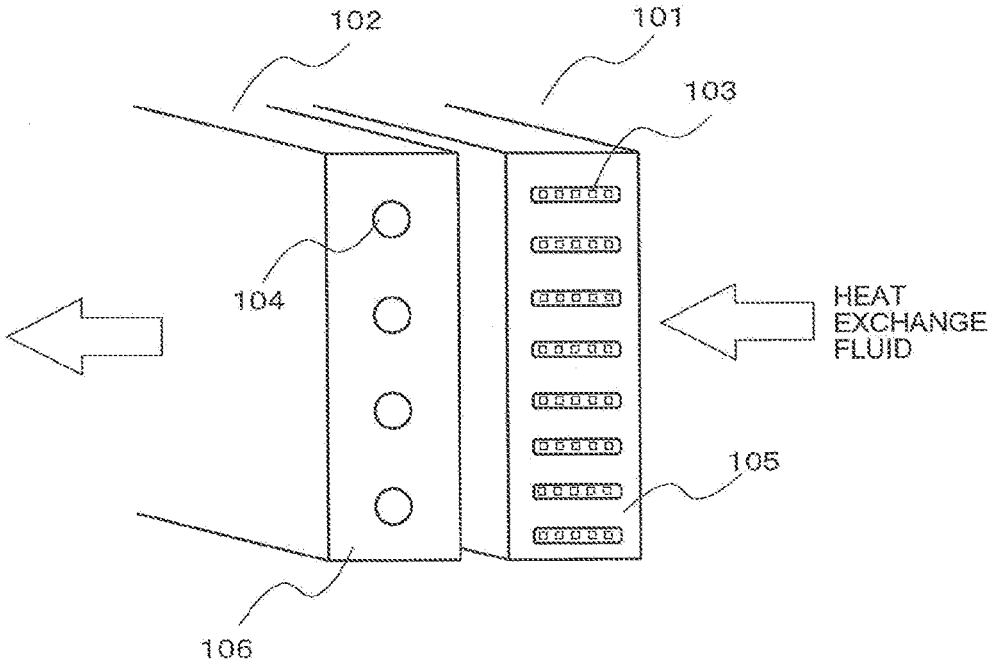
FIG. 2 is a configuration view of the heat exchanger according to Embodiment 1.

FIG. 2 is a configuration view of the heat exchanger according to Embodiment 1.

A refrigeration cycle apparatus includes a compressor 201 that compresses gas refrigerant, a four-way valve 202 that switches a flow path of refrigerant discharged from the compressor 201, a use side heat exchanger 203 that exchanges heat between indoor air and refrigerant, an expansion valve 204 that decompresses refrigerant, and heat source side heat exchangers 101, 102 that exchange heat between outdoor air and refrigerant, which are connected by a refrigerant pipe.

The use side heat exchanger 203 is disposed adjacent to the use side air-sending device 205. The use side air-sending device 205 sends the indoor air, which is a heat exchange fluid, to the use side heat exchanger 203. The heat source side heat exchangers 101, 102 are disposed adjacent to the heat source side air-sending device 206. The heat source side air-sending device 206 sends the outdoor air, which is a heat exchange fluid to the heat source side heat exchangers 101, 102.

The heat source side heat exchangers 101, 102 are fin-tube type heat exchangers which include a plurality of heat-transfer tubes 103, 104 disposed parallel to each other and plate-shaped fins 105, 106 disposed substantially vertical to the heat-transfer tubes 103, 104 in a heat-transferrable manner. The first heat source side heat exchanger 101 and the second heat source side heat exchanger 102 are disposed on the upstream side and downstream side in the air-flow direction of the heat source side air-sending device 206, respectively. The heat-transfer tubes of the first heat source side heat exchanger 101 and the second heat source side heat exchanger 102 are connected so that refrigerant flows in series.

Next, a configuration of the first heat source side heat exchanger 101 and the second heat source side heat exchanger 102 is described in detail.

In the heat source side heat exchangers 101, 102 according to Embodiment 1, the sum of flow path volume of each of the heat-transfer tubes 103 of the first heat source side heat exchanger 101 is smaller than the sum of flow path volume of each of the heat-transfer tubes 104 of the second heat source side heat exchanger 102.

Further, the sum of cross sectional areas of the flow path of the heat-transfer tubes 103 taken in the direction vertical to the axial direction of the heat-transfer tubes 103 of the first heat source side heat exchanger 101 is smaller than the sum of cross sectional areas of the flow path of the heat-transfer tubes 104 taken in the direction vertical to the axial direction of the heat-transfer tubes 104 of the second heat source side heat exchanger 102.

The sum of hydraulic equivalent diameters (equivalent diameters) of each of the heat-transfer tubes 103 of the first heat source side heat exchanger 101 is smaller than the sum of hydraulic equivalent diameters (equivalent diameters) of each of the heat-transfer tubes 104 of the second heat source side heat exchanger 102.

The hydraulic equivalent diameter (equivalent diameter) (d) refers to a representative length of a diameter of a circular tube which is equivalent to one flow path of the heat-transfer tube. The hydraulic equivalent diameter (equivalent diameter) (d) can be expressed by the following equation: $d=4A/L$ (where A is a cross sectional area of flow path, and L is a wet perimeter (length of wall surface in the flow path cross section).

For each of the heat-transfer tubes 103, 104, the heat-transfer tube 103 of the first heat source side heat exchanger 101 is a flat multi-hole tube and the heat-transfer tube 104 of the second heat source side heat exchanger 102 is a circular tube as shown in FIG. 2.

Using a flat multi-hole tube as the heat-transfer tube 103 of the first heat source side heat exchanger 101 can improve heat exchange efficiency of the first heat source side heat exchanger 101 so that the first heat source side heat exchanger 101 can serve as a main heat exchanger.

In addition, the first heat source side heat exchanger 101 may include a circular tube and the second heat source side heat exchanger 102 may include a flat multi-hole tube as long as the above relationship of the flow path volume and the hydraulic equivalent diameter of the heat-transfer tube is established. Further, the number of tubes and the number of paths of the heat-transfer tubes 103, 104 in the heat source side heat exchangers 101, 102 are not specifically limited.

The cross sectional arrangement of each of the heat-transfer tubes 103, 104 of the first heat source side heat exchanger 101 and the second heat source side heat exchanger 102 may be a grid pattern arrangement parallel to the flowing direction of air, which is a heat exchange fluid, or a zig zag pattern arrangement that improves heat transfer efficiency.

Further, the pitch, which is an interval between each of the heat-transfer tubes 103, 104, can be designed such that the heat-transfer tubes 103 of the first heat source side heat exchanger 101 have a small pitch and the heat-transfer tubes 104 of the second heat source side heat exchanger 102 have a large pitch, and the number of the heat-transfer tubes 103 is twice of the number of the heat-transfer tubes 104 so that the first heat source side heat exchanger 101 can serve as a main heat exchanger having a larger volume.

Further, the sum of in-tube heat transfer areas of the heat-transfer tubes 103 which is defined by the sum of inner surface areas may be larger than the sum of in-tube heat transfer areas of the heat-transfer tube 104.

The pitch of the fins 105, 106 of the first heat source side heat exchanger 101 and the second heat source side heat exchanger 102 can be designed such that the fins 105 of the first heat source side heat exchanger 101 have a small pitch and the fins 106 of the second heat source side heat exchanger 102 have a large pitch, for example, the number of the fins 105 is twice of the number of the fins 106 so that the first heat source side heat exchanger 101 can serve as a main heat exchanger having a larger volume. Moreover, the sum of surface areas of the fins 105, 106 may be different such that the sum of surface areas of the fins 105 of the first heat source side heat exchanger 101 is larger than or equal to the sum of surface areas of the fins 106 of the second heat source side heat exchanger 102.

Furthermore, by appropriately combining the configuration of the above heat-transfer tubes 103, 104 and the fins 105, 106, the first heat source side heat exchanger 101 can serve as a main heat exchanger having a small flow path volume of the heat-transfer tube but having a large heat exchange capacity and the second heat source side heat exchanger 102 can serve as a sub-heat exchanger that assists the main heat exchanger.

Then, an operation of heating mode of the refrigeration cycle apparatus including the heat exchanger according to Embodiment 1 will be described.

Gas refrigerant of high temperature and high pressure flowing out the compressor 201 flows into the use side heat exchanger 203 via the four-way valve 202.

Refrigerant flowing into the use side heat exchanger 203 is cooled and condensed by exchanging heat with indoor air, and then flows into the expansion valve 204 to be decompressed.

The decompressed refrigerant of low temperature flows through the first heat source side heat exchanger 101 and the second heat source side exchange heat 102 in sequence, and is heated by outdoor air and becomes gas refrigerant, and is then suctioned into the compressor 201 via the four-way valve 202.

During the heating mode, the heat source side heat exchangers 101, 102 are used as an evaporator, and refrigerant flows from the first heat source side heat exchanger 101 to the second heat source side heat exchanger 102 in a direction parallel to the flow direction of air sent by the heat source side air-sending device 206.

Then, the refrigerant state in the heat source side heat exchangers 101, 102 will be described.

FIG. 3 is a diagram which shows an accumulated amount of refrigerant stagnated in the heat-transfer tube when the heat source side heat exchanger according to Embodiment 1 is used as an evaporator.

FIG. 4 is a diagram which shows pressure loss generated in the heat-transfer tube when the heat source side heat exchanger according to Embodiment 1 is used as an evaporator.

Since refrigerant flowing into the first heat source side heat exchanger 101 is heated by outdoor air, the quality increases in the flow direction. Further, the quality of refrigerant in the second heat source side heat exchanger 102 also increases in the flow direction. Accordingly, the density of refrigerant gradually decreases in the flow direction.

As described above, in the heat source side heat exchangers 101, 102, the sum of flow path volume of each of the heat-transfer tubes 103 of the first heat source side heat exchanger 101 is smaller than the sum of flow path volume of each of the heat-transfer tubes 104 of the second heat source side heat exchanger 102.

Accordingly, when the heat source side heat exchangers 101, 102 according to Embodiment 1 are used as an evaporator, the accumulated amount of refrigerant in the heat-transfer tubes 103, 104 from the heat exchanger inlet is indicated by the curve [3] shown in FIG. 3.

Although refrigerant flowing into the first heat source side heat exchanger 101 has a small quality and a large refrigerant density, the sum of flow path volume of each of the heat-transfer tubes 103 is small relative to that of the second heat source side heat exchanger 102, and accordingly, the amount of refrigerant stagnated in each of the heat-transfer tubes 103 can be decreased.

Further, even if refrigerant flows into the second heat source side heat exchanger 102 and the sum of flow path volume of each of the heat-transfer tubes 104 is relatively large to that of the first heat source side heat exchanger 101, the amount of refrigerant stagnated in the heat-transfer tube 104 can be decreased since refrigerant has a large quality and a small refrigerant density.

Accordingly, the amount of refrigerant stagnated in the heat source side heat exchangers 101, 102 can be decreased as a whole.

The curve [1] in FIG. 3 is the accumulated amount of refrigerant in the case where the configuration of the heat-transfer tubes 104 of the second heat source side heat exchanger 102 is used for the heat-transfer tubes 103 of the first heat source side heat exchanger 101 so that the sum of flow path volume of the heat-transfer tube 103 of the first heat source side heat exchanger 101 becomes as large as that of the heat-transfer tubes 104 of the second heat source side heat exchanger 102.

Further, the curve [2] in FIG. 3 is the accumulated amount of refrigerant in the case where the configuration of the heat-transfer tubes 103 of the first heat source side heat exchanger 101 and the configuration of the heat-transfer tubes 104 of the second heat source side heat exchanger 102 are replaced with each other so that the sum of flow path volume of each of the heat-transfer tubes 104 of the second heat source side heat exchanger 102 is smaller than the sum of flow path volume of each of the heat-transfer tubes 103 of the first heat source side heat exchanger 101.

The curve [4] in FIG. 3 is the accumulated amount of refrigerant in the case where the configuration of the heat-transfer tubes 103 of the first heat source side heat exchanger 101 is used for the heat-transfer tubes 104 of the second heat source side heat exchanger 102 so that the sum of flow path volume of the heat-transfer tube 104 of the second heat source side heat exchanger 102 becomes as small as that of the heat-transfer tubes 103 of the first heat source side heat exchanger 101.

Further, the pressure loss of refrigerant passing through the heat-transfer tubes increases with increase of the quality of refrigerant. However, since the sum of hydraulic equivalent diameters (equivalent diameters) of each of the heat-transfer tubes 104 of the second heat source side heat exchanger 102 which has a large quality is larger than the sum of hydraulic equivalent diameters (equivalent diameters) of each of the heat-transfer tubes 103 of the first heat source side heat exchanger 101, increase in pressure loss in each of the heat-transfer tubes 104 of the second heat source side heat exchanger 102 which has a large effect can be prevented as shown in the curve [3] in FIG. 4.

Accordingly, the pressure loss of refrigerant in each of the heat-transfer tubes 103, 104 of the heat source side heat exchangers 101, 102 can be reduced as a whole.

The curve [1] in FIG. 4 which is shown as a comparative example is pressure loss in the case where the configuration of the heat-transfer tubes 104 of the second heat source side heat exchanger 102 is used for the heat-transfer tubes 103 of the first heat source side heat exchanger 101 so that the sum of hydraulic equivalent diameters of the heat-transfer tube 103 of the first heat source side heat exchanger 101 becomes as large as that of the heat-transfer tubes 104 of the second heat source side heat exchanger 102.

Further, the curve [2] in FIG. 4 is pressure loss in the case where the configuration of the heat-transfer tubes 103 of the first heat source side heat exchanger 101 and the configuration of the heat-transfer tubes 104 of the second heat source side heat exchanger 102 are replaced with each other so that the sum of flow path volume of each of the heat-transfer tubes 104 of the second heat source side heat exchanger 102 is smaller than the sum of hydraulic equivalent diameters of each of the heat-transfer tubes 103 of the first heat source side heat exchanger 101.

The curve [4] in FIG. 4 is pressure loss in the case where the configuration of the heat-transfer tubes 103 of the first heat source side heat exchanger 101 is used for the heat-transfer tubes 104 of the second heat source side heat exchanger 102 so that the sum of hydraulic equivalent diameter of the heat-transfer tubes 104 of the second heat source side heat exchanger 102 becomes as small as that of the heat-transfer tube 103 of the first heat source side heat exchanger 101.

When further decrease in pressure loss in the first heat source side heat exchanger 101 and the second heat source side heat exchanger 102 is desired, a multi-path heat-transfer tubes may be used by providing a distributor on upstream side of the first heat source side heat exchanger 101 so as to separate refrigerant into a plurality of heat-transfer tubes 103, thereby reducing the flow rate of refrigerant flowing in the heat-transfer tubes.

Then, an operation of cooling mode of the refrigeration cycle apparatus including the heat exchanger according to Embodiment 1 will be described.

FIG. 5 is a diagram of a refrigerant circuit that performs a cooling operation while the heat exchanger according to Embodiment 1 is mounted on the heat source unit.

Gas refrigerant of high temperature and high pressure flowing out the compressor 201 flows into the heat source side heat exchangers 101, 102 via the four-way valve 202.

Refrigerant flowing into the heat source side heat exchangers 101, 102 is cooled and condensed by exchanging heat with outdoor air, and then flows into the expansion valve 204 to be decompressed.

The decompressed refrigerant of low temperature flows into the use side heat exchanger 203 and is heated by indoor air and becomes gas refrigerant, and is then suctioned into the compressor 201 via the four-way valve 202.

During the cooling mode, the heat source side heat exchangers 101, 102 are used as a condenser, and refrigerant flows from the second heat source side heat exchanger 102 to the first heat source side heat exchanger 101 in a direction opposed to the flow direction of air sent by the heat source side air-sending device 206.

Then, the refrigerant state in the heat source side heat exchangers 101, 102 will be described.

FIG. 6 is a diagram which shows an accumulated amount of refrigerant stagnated in the heat-transfer tube when the heat source side heat exchanger according to Embodiment 1 is used as a condenser.

FIG. 7 is a diagram which shows pressure loss generated in the heat-transfer tube when the heat source side heat exchanger according to Embodiment 1 is used as a condenser.

Since refrigerant flowing into the second heat source side heat exchanger 102 is cooled by outdoor air, the quality decreases along the flow direction. Further, the quality of refrigerant in the first heat source side heat exchanger 101 also decreases in the flow direction. Accordingly, the density of refrigerant gradually increases in the flow direction.

As described above, in the heat source side heat exchangers 101, 102, the sum of flow path volume of each of the heat-transfer tubes 103 of the first heat source side heat exchanger 101 is smaller than the sum of flow path volume of each of the heat-transfer tubes 104 of the second heat source side heat exchanger 102.

Accordingly, when the heat source side heat exchangers 101, 102 according to Embodiment 1 are used as a condenser, the accumulated amount of refrigerant in the heat-transfer tubes 103, 104 from the heat exchanger inlet is indicated by the curve [3] shown in FIG. 6.

Since refrigerant flowing into the second heat source side heat exchanger 102 has a large quality and a small refrigerant density, the amount of refrigerant stagnated in each of the heat-transfer tubes 104 can be decreased even if the sum of flow path volume of each of the heat-transfer tubes 104 is relatively large to that of the first heat source side heat exchanger 101.

After that, although refrigerant flowing into the first heat source side heat exchanger 101 has a small quality and a large refrigerant density, the sum of flow path volume of each of the heat-transfer tubes 103 is relatively small to that of the second heat source side heat exchanger 102, and accordingly, the amount of refrigerant stagnated in each of the heat-transfer tubes 103 can be decreased.

Accordingly, the amount of refrigerant stagnated in the heat source side heat exchangers 101, 102 can be decreased as a whole.

The curves [1], [2], and [4] in FIG. 6 are shown for purpose of comparison and represent the same configuration as each of the heat-transfer tubes 103, 104 of the heat source side heat exchangers 101, 102 described for FIG. 3.

Further, the pressure loss of refrigerant passing through the heat-transfer tubes increases with increase of the quality of refrigerant. However, since the sum of hydraulic equivalent diameters (equivalent diameters) of each of the heat-transfer tubes 104 of the second heat source side heat exchanger 102 which has a large quality is larger than the sum of hydraulic equivalent diameters (equivalent diameters) of each of the heat-transfer tubes 103 of the first heat source side heat exchanger 101, increase in pressure loss in each of the heat-transfer tubes 104 of the second heat source side heat exchanger 102 which has a large effect can be prevented as shown in the curve [3] in FIG. 7.

Accordingly, the pressure loss of refrigerant in each of the heat-transfer tubes 103, 104 of the heat source side heat exchangers 101, 102 can be reduced as a whole.

The curves [1], [2], and [4] in FIG. 7 are shown for purpose of comparison and represent the same configuration as each of the heat-transfer tubes 103, 104 of the heat source side heat exchangers 101, 102 described for FIG. 4.

When further decrease in pressure loss in the first heat source side heat exchanger 101 and the second heat source side heat exchanger 102 is desired, a multi-path heat-transfer tubes may be used by providing a distributor on upstream side of the second heat source side heat exchanger 102 so as to divide refrigerant into a plurality of heat-transfer tubes 104, thereby reducing the flow rate of refrigerant flowing in the heat-transfer tubes.

Moreover, the heat-transfer tubes 103, 104 and the fins 105, 106 that constitute the first heat source side heat exchanger 101, the second heat source side heat exchanger 102 and the use side heat exchanger 203 may be made of aluminum or aluminum alloy so as to prevent corrosion between different metals and reduce weight.

Although a two-row configuration of the heat exchanger of the first heat source side heat exchanger 101 and the second heat source side heat exchanger 102 is applied to the heat source side heat exchangers 101, 102 in Embodiment 1, the two-row configuration of the heat exchanger can be used for the use side heat exchanger 203.

Since the above configuration of the heat-transfer tube is used for the heat source side heat exchangers 101, 102 according to Embodiment 1, the amount of refrigerant stagnated in the heat-transfer tubes can be reduced and the pressure loss in the heat-transfer tubes of the heat exchangers as a whole can be reduced.

Embodiment 2

Referring to FIG. 8, the heat exchanger according to Embodiment 2 will be described.

Since the heat exchanger according to Embodiment 2 basically includes the heat-transfer tubes 103, 104 of the first heat source side heat exchanger 101 and the second heat source side heat exchanger 102 according to Embodiment 1, only differences therebetween will be described.

FIG. 8 is a schematic view which shows the heat exchanger according to Embodiment 2 is applied to an outdoor unit.

In Embodiment 2, three row of heat exchangers are disposed in the flowing direction of the heat exchange fluid, which are made up of two rows of the first heat source side heat exchanger 101 having an L-shaped and one row of the second heat source side heat exchanger 102 having a plate shape. A width dimension of the second heat source side heat exchanger 102 is smaller than a width dimension of the straight portion of the first heat source side heat exchanger 101. Further, a height dimension of the second heat source side heat exchanger 102 may be smaller than a height dimension of the first heat source side heat exchanger 101.

With this configuration, since the second heat source side heat exchanger 102 is formed in a plate shape, a manufacturing cost for bending the heat-transfer tubes can be reduced.

Further, since the above configuration of the heat-transfer tube is used for the heat source side heat exchangers 101, 102 similarly to Embodiment 1, the amount of refrigerant stagnated in the heat-transfer tube can be reduced and the pressure loss in the heat-transfer tubes of the heat exchangers as a whole can be reduced.

Although Embodiment 1 and Embodiment 2 are described above, the present invention is not limited to the description of those embodiments. For example, all or part of each embodiment can be combined.

REFERENCE SIGNS LIST

101 first heat source side heat exchanger 102 second heat source side heat exchanger 103 heat-transfer tube 104 heat-transfer tube 105 fin 106 fin 201 compressor 202 four-way valve 203 use side heat exchanger 204 expansion valve 205 use side air-sending device 206 heat source side air-sending device

The invention claimed is:

1. A heat exchanger comprising a first heat exchanger disposed on upstream side of a heat exchange fluid and a second heat exchanger disposed on downstream side of the heat exchange fluid, the first heat exchanger and the second heat exchanger being connected in series in a flow path of a heat medium, wherein the heat exchanger is configured to allow the heat medium to flow from the first heat exchanger to the second heat exchanger so as to be parallel to the flow of the heat exchange fluid when the heat exchanger serves as an evaporator, and allow the heat medium to flow from the second heat exchanger to the first heat exchanger so as to be opposed to the flow of the heat exchange fluid when the heat exchanger serves as a condenser, a sum of flow path volume of first heat-transfer tubes of the first heat exchanger is smaller than a sum of flow path volume of second heat-transfer tubes of the second heat exchanger and a pitch between the first heat-transfer tubes is smaller than a pitch between the second heat-transfer tubes, the number of the first heat-transfer tubes is greater than the number of the second heat-transfer tubes, the first heat exchanger has an L-shaped cross section having a long side and a short side, the second heat exchanger has a plate shape, the first heat exchanger is disposed such that an outer circumference surface of the long side is arranged on the upstream side in a flowing direction of the heat exchange fluid, and such that an inner circumference surface of the long side is arranged on the downstream side in the flowing direction of the heat exchange fluid, the second heat exchanger is stacked on the inner circumference surface of the long side in the flowing direction of the heat exchange fluid, and a height dimension of the second heat exchanger is smaller than a height dimension of the first heat exchanger.

2. The heat exchanger of claim 1, wherein a sum of cross sectional areas of the first heat-transfer tubes of the first heat exchanger is smaller than a sum of cross sectional areas of the second heat-transfer tubes of the second heat exchanger.

3. The heat exchanger of claim 1, wherein a sum of hydraulic equivalent diameters of the first heat-transfer tubes of the first heat exchanger is smaller than a sum of hydraulic equivalent diameters of the second heat-transfer tubes of the second heat exchanger.

4. The heat exchanger of claim 1, wherein each of the first heat-transfer tubes is a flat multi-hole tube and each of the second heat-transfer tubes is a circular tube.

5. The heat exchanger of claim 1, wherein a cross sectional area of fins of the first heat exchanger is larger than a cross sectional area of fins of the second heat exchanger.

6. The heat exchanger of claim 1, wherein a sum of in-tube heat transfer areas of the first heat-transfer tubes is larger than a sum of in-tube heat transfer areas of the second heat-transfer tubes.

7. The heat exchanger of claim 1, wherein a cross sectional arrangement of the first heat-transfer tubes and the second heat-transfer tubes is a zig zag arrangement so as not to overlap each other in a flowing direction of the heat exchange fluid.

8. The heat exchanger of claim 1, wherein fins of the first heat exchanger and the second heat exchanger and the first heat-transfer tubes and the second heat-transfer tubes are made of aluminum.

9. A refrigeration cycle apparatus, wherein the heat exchanger of claim 1 is used for at least one of a use side heat exchanger and a heat source side heat exchanger.

10. The heat exchanger of claim 1, wherein a width dimension of the second heat exchanger is smaller than a width dimension of the straight portion of the first heat exchanger.

* * * * *